US007678210B1

(12) United States Patent
Newman et al.

(10) Patent No.: US 7,678,210 B1
(45) Date of Patent: Mar. 16, 2010

(54) INJECTION LOADING OF HIGHLY FILLED EXPLOSIVE SUSPENSIONS

(75) Inventors: Kirk E. Newman, Yorktown, VA (US); James A. Gusack, Williamsburg, VA (US); Lisa A. Mondy, Cedar Crest, NM (US); Alan L. Graham, Los Alamos, NM (US); Ronald E. Smith, Los Alamos, NM (US); William J. Parkinson, Los Alamos, NM (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 136 days.

(21) Appl. No.: 10/794,655

(22) Filed: Mar. 8, 2004

(51) Int. Cl.
*D03D 23/00* (2006.01)

(52) U.S. Cl. ..... 149/109.6

(58) Field of Classification Search ..... 149/109.6
See application file for complete search history.

(56) References Cited

U.S. PATENT DOCUMENTS

| | | | | |
|---|---|---|---|---|
| 2,203,980 A | | 6/1940 | Burt | 137/165 |
| 2,724,580 A | | 11/1955 | Revallier | 259/4 |
| 2,890,027 A | | 6/1959 | Fischer | 259/16 |
| 2,939,176 A | | 6/1960 | Adelman | 18/30 |
| 2,958,333 A | | 11/1960 | Poettmann et al. | 137/3 |
| 2,998,772 A | * | 9/1961 | Land | 102/499 |
| 3,186,817 A | | 6/1965 | Novack | 65/130 |
| 3,486,516 A | | 12/1969 | Stoertz | 137/8 |
| 3,559,464 A | * | 2/1971 | Foust et al | 73/54.06 |
| 3,664,096 A | | 5/1972 | LeJeune | 55/466 |
| 3,667,732 A | | 6/1972 | LeJeune | 259/4 |
| 4,341,244 A | | 7/1982 | Facchini | 141/18 |
| 4,850,217 A | * | 7/1989 | Nunn | 73/54.11 |
| 5,111,531 A | * | 5/1992 | Grayson et al. | 706/23 |
| 5,387,095 A | | 2/1995 | Mahoney et al. | 425/145 |
| 5,914,884 A | * | 6/1999 | Gur Ali et al. | 700/200 |
| 6,390,661 B1 | | 5/2002 | Bellasalma et al. | 366/162.3 |

* cited by examiner

*Primary Examiner*—Aileen Felton
(74) *Attorney, Agent, or Firm*—Fredric J. Zimmerman

(57) ABSTRACT

A process for mitigating shear induced particle migration of highly filled explosive suspensions during injection loading of the explosive suspension into a confined container that includes monitoring particle migration within the highly filled explosive suspension and correcting flow parameters effective to reduce the particle migration.

12 Claims, 12 Drawing Sheets

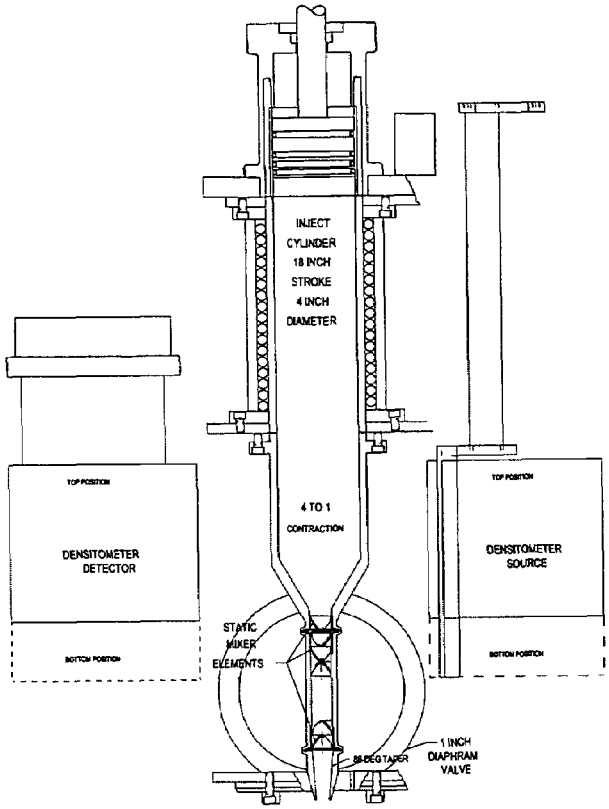
FIG. 8A
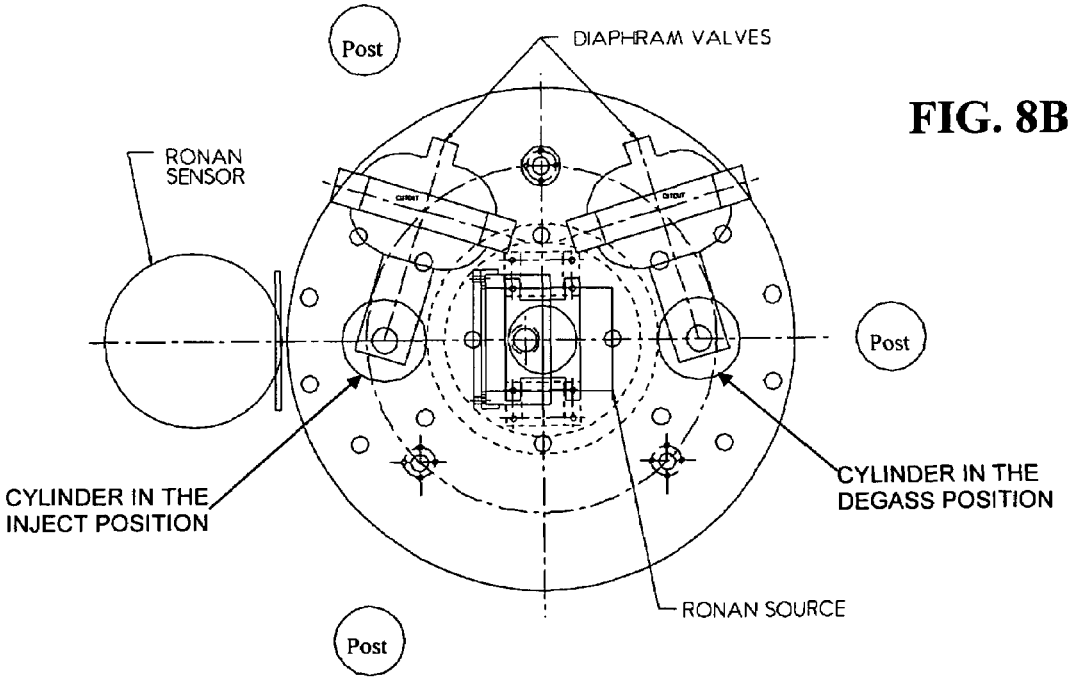
FIG. 8B
FIG. 8

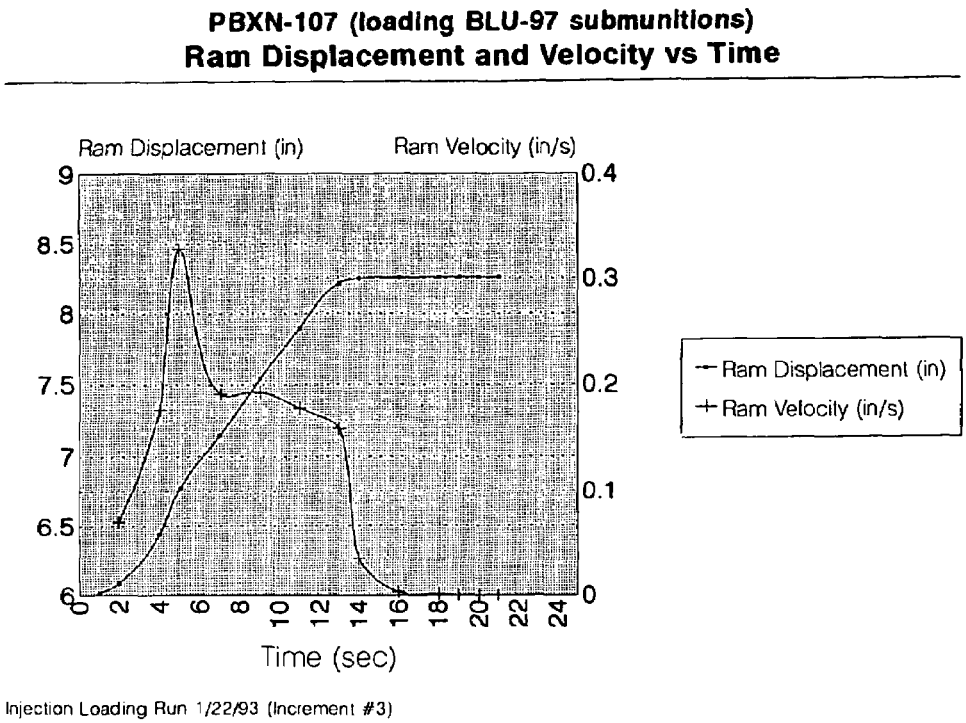
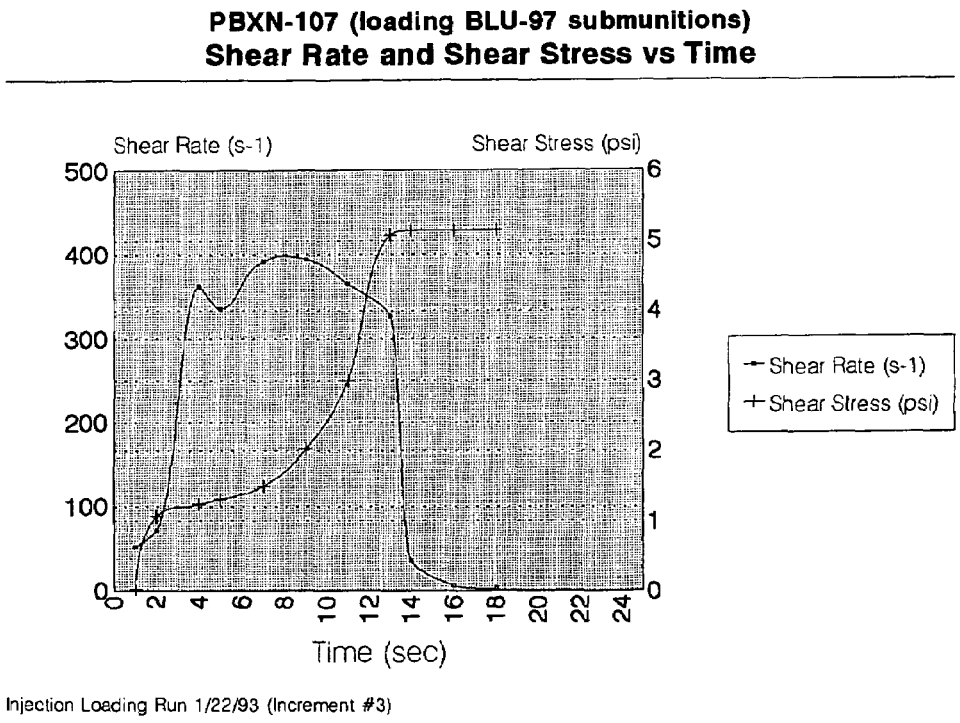
FIG. 9A (top)
FIG. 9B (bottom)

INJECTION LOADING OF HIGHLY FILLED EXPLOSIVE SUSPENSIONS

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention provides a process for mitigating shear induced particle migration of highly filled explosive suspensions during injection loading of the explosive suspension into a confined container.

2. Brief Description of the Related Art

Methods of using commercial bottle-filling devices for highly filled suspensions produces a high level of unacceptable ordnance because of process design defects and the complete reliance upon post-mortem radiography to determine pass or fail. Injection loading corrected several problems associated with the process design problems of commercial bottle-filling machines, but did not have sufficient process control to preemptively prevent the manufacture of reject ordnance. Injection loading remains reliant upon post-mortem radiography to determine acceptance and confirm suspected rejects, particularly when processing low viscosity plastic-bonded explosive (PBX).

Injection loading is an inter-disciplinary technology for transport operations being performed upon highly filled suspensions through narrow flow channels. Similar to injection molding techniques practiced in the plastics industry, a piston is used to transfer the viscous suspension from a reservoir into a mold cavity (see e.g., Tobin, W. J., *Fundamentals of Injection Molding,* 2$^{nd}$ edition, WJT Associates, Louisville, Colo., ISBN: 0-9369-9419-3, 2000 and Rosato, D. V., Rosato, D. V., and Rosato, G. R., *Injection Molding Handbook,* 3$^{rd}$ edition, Kluwer Academic Publishers, Boston, ISBN: 0-7923-8619-1, 2001). However, unlike the traditional injection molding techniques, the mold is a component of the product rather than a component of the machine. Similar to the commercial bottle filling machines used in the food or pharmaceutical industries, the mold is a container that approaches the dispensing device where it is filled, and then taken away for final packaging (see e.g., Soroka, W., *Fundamentals of Packaging Technology,* 2$^{nd}$ edition, IoPP Press, Naperville, Ill., ISBN: 1-5667-6862-4, 1998).

There is a need in the art to provide improved methods for injecting highly filled explosive suspensions into confined containers. The present invention addresses this and other needs.

SUMMARY OF THE INVENTION

The present invention includes a process for mitigating shear induced particle migration of highly filled explosive suspensions during injection loading of the explosive suspension into a confined container comprising the steps of monitoring particle migration within the highly filled explosive suspension and correcting flow parameters effective to reduce the particle migration. Monitored parameters include volumetric flowrate, apparent shear rate, shear stress and apparent viscosity of the explosive composition. Corrective procedures may include modifications of a splitter plate design, reducing restrictive contraction ratios and/or length to diameter ratios of a feeder mechanism, augmentation of in-line static mixer elements, increasing piston stroke of a feeder mechanism and the like. The process of the present invention provides a non-separated highly filled explosive suspension product within a confined container.

DETAILED DESCRIPTION OF THE DRAWINGS

FIGS. 8A and 8B illustrate a side view and top view, respectively, of the RONAN densitometer detector/sensor in combination with an injection loading apparatus;

FIGS. 9A and 9B, illustrate ram displacement and velocity versus time (FIG. 9A) and shear rate and shear stress versus time (FIG. 9B);

DETAILED DESCRIPTION OF THE PREFERRED EMBODIMENT

The present invention includes a process for mitigating shear induced particle migration of highly filled explosive suspensions during injection loading of the explosive suspension into a confined container that includes the steps of monitoring particle migration within the highly filled explosive suspension and correcting flow parameters effective to reduce the particle migration. Monitoring of the process allows in situ corrective actions. Correction of the process includes physical and operational designs of the injection loading to minimize gradients. The process of the present invention provides a non-separated highly filled explosive suspensions product in an explosive filled confined container product. Preferably the explosive filled confined container contains an explosive of PBX. The present invention preferably uses I/O monitoring and adaptive process control to preemptively predict disturbances and invoke corrective actions to prevent the manufacture of defective ordnance. The result is the reduction, or elimination, of reject ordnance and the associated explosive hazardous waste.

Figure 1:
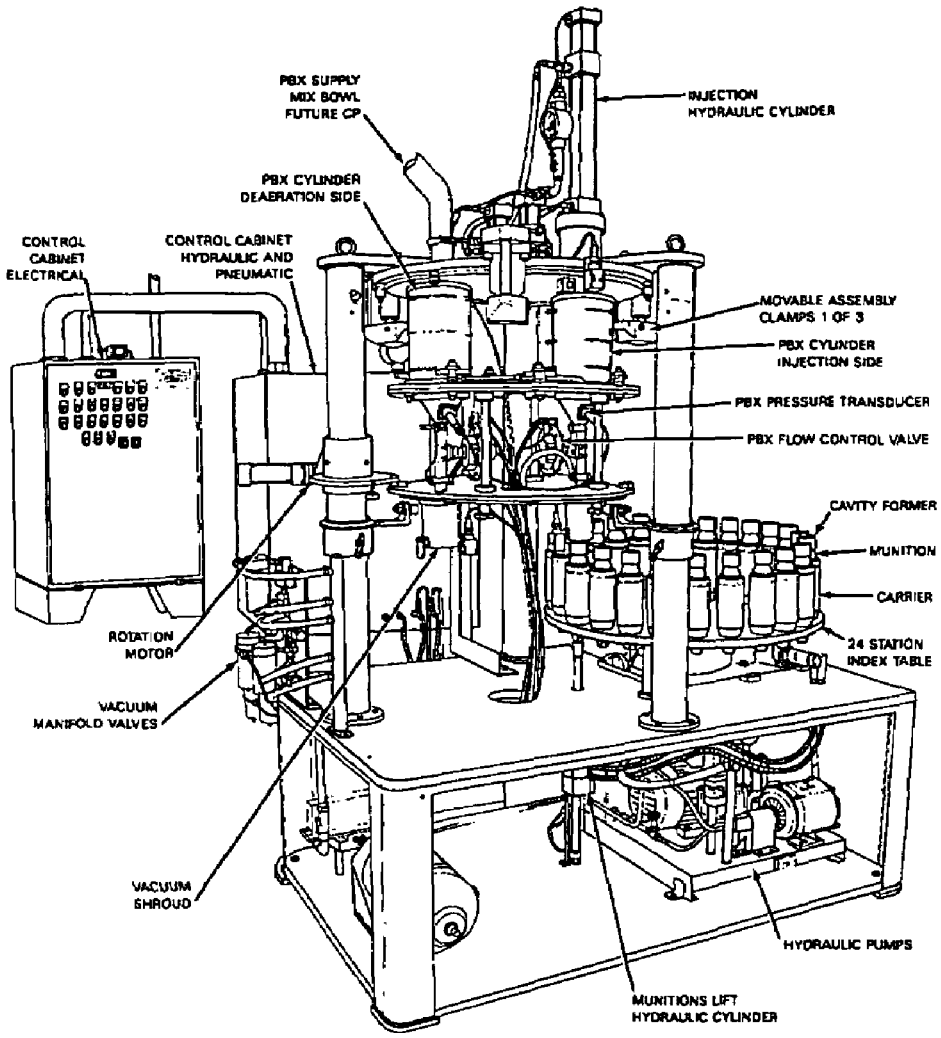
FIG. 1 illustrates one embodiment of an injection loading apparatus for filling confined containers with highly filled explosive suspensions.

Referring to FIG. 1, injection loading features of the present invention preferably include a dispensing device as that disclosed in U.S. Pat. No. 5,387,095, to Mahoney et al., entitled "Apparatus for Injection Molding High-Viscosity Materials", issued on Feb. 7, 1995, the disclosure of which is herein incorporated by reference in its entirety. This device is designed to simultaneously degass and transport aliquots of a viscous suspension into containers. The injection loader can provide a substantial driving force for momentum transport and has simple process geometry that minimizes mass transfer problems usually associated with flow through corner turns, abrupt contractions, or multiple-port manifolds (see e.g., FIG. 1 of U.S. Pat. No. 5,387,095).

Even though injection loading technology can be relatively complex, it offers potential to be an efficient automated unit operation. The product quality and the production rate are dependent upon several factors. Some of these factors can be elucidated from the domains of energetic material formulation, process design, and process control.

Highly filled suspensions of the present invention include energetic material formulations. Highly filled suspensions preferably include solid contents of from about 20%/wt or greater, such as solid contents of from about 30%/wt or greater, 50%/wt or greater, 70%/wt or greater and the like. The formulations for injection loading applications are usually multi-component highly filled viscoelastic thermosetting suspensions that transition to a wet paste before finally curing to take on the properties of an elastomer. These formulations are known as plastic bonded explosives (PBX). The particles are high performance nitramines that have a high chemical energy value and a high crystalline density (see e.g., Kamlet, M. J. and Jacobs, S. J., "Chemistry of Detonations, Part I: A Simple Method of Calculation of Detonation Properties of C—H—N—O Explosives," *J. Chem. Phys.,* 48 (1968), 23; Baroody, E. E. and Peters, S. T., "Heat of Explosion, Heat of Detonation, and Reaction Products: Their Estimation and Relation to the First Law of Thermodynamics," *IHTR* 1340, NSWC Indian Head, Md., 7 May 1990; and Fried, L. E., Murphy, M. J., Souers, P. C., Wu, B. J., Anderson, S. R., McGuire, E. M., and Maiden, D. E., "Detonation Modeling with an In-Line Thermochemical Equation of State," Proceedings of the 11th International Detonation Symposium, Snowmass Village, Colo., 31 Aug.-4 Sep. 1998, p. 889, the disclosures of these reference herein incorporated by reference). The desired concentration of nitramine particles in the formulation is close to the maximum packing fraction (see e.g., Ferguson, J. and Kemblowski, Z., *Applied Fluid Rheology*, Elsevier Applied Science, London, ISBN: 1-8516-6588-9, 1991). The thermosetting binder is plasticized, and is usually either polyurethane or polyacrylate. The particles tend to be slightly negatively buoyant early in the polymerization process, but become neutrally buoyant in the binder as polymerization proceeds beyond a threshold molecular weight. Processing PBX formulations that are designed for injection loading applications is a difficult process to control. Unlike liquid compositions, exclusive monitoring of ram displacement and velocity are not predictable control points for injection loading. The particle size distribution, binder selection, and apparent rheological behavior affect successful and reproducible processing.

The Particle Size Distribution (PSD) is generally optimized for injection loading formulations. The maximum packing fraction of highly filled polymeric systems is dependent upon several variables, with two principal variables being the number of grist modes and the aspect ratio of particles in each grist mode. For example in McGeary, R. K., "Mechanical Packing of Spherical Particles," *J. Amer. Ceram. Soc.,* 44 (1961), 513, it is disclosed that a ternary mixture of hard spheres has a sufficiently high packing fraction to yield 90% of theoretical density, if the particle diameter of each of the three discrete component grist modes differs by at least a factor of seven. A ternary mixture of this type has the desirable property of being a free flowing mixture of solid particles. Others references, such as Yu, A. B. and Standish, N., "A Study of the Packing of Particles with a Mixture Size Distribution," *Powder Technology,* 76 (1993), 113 and Nolan, G. T. and Kavanagh, P. E., "Computer Simulation of Random Packings of Spheres with Log-Normal Distributions," *Powder Technology,* 76 (1993), 309, have studied the packing of particles having grist size distributions within each mode of a multi-modal mixture, and acknowledge the influence of infrastructure and microstructure upon packing. The packing of particles having a mixture size distribution may be very different from that with a discrete size distribution. There is some evidence that broader distributions in a grist mode may be helpful in reducing the resultant viscosity of a multi-modal PSD suspension (see e.g., Chong, J. S., Christiansen, E. B., and Baer, A. D., "Rheology of Concentrated Suspensions", *J. Appl. Polym. Sci.,* 15 (1971), 2007). Some of the packing efficiency appears to be gained by hexagonal alignment of non-spherical particles having favorable aspect ratios. However, there is a limit to the packing efficiency gained by the randomness in a broad PSD. Often the problem becomes unpredictable by computational methods, especially when the particle shape is insufficiently controlled to estimate using discrete aspect ratios. Hence, the optimization of PSD for these energetic material formulations is performed experimentally. Usually a tri-modal or tetra-modal mixture of relatively broad grist size distributions having approximately the same shape (axis-symmetric ellipsoids) can achieve the desired degree of fill for injection loading PBX formulations.

The purpose of the binder is to insulate the nitramine particles, and provide some structure to the final form of the energetic material. However, during processing, the binder plays at least two specific roles. First, the unreacted binder should contain components that reduce the interfacial tension at the surface of nitramine particles. These components are not necessarily surfactants. They can be liquid organic plasticizers of low molecular weight that have an affinity for the monomer and the resultant polymer. Plasticizers not only lower the glass transition temperature of the resultant polymer, but during processing, they dilute the monomer and offer a free volume of fluid that can participate as a molecular lubricant. This latter phenomenon promotes wetting of the nitramine particles (see e.g., Adamson, A. W., and Gast, A., *Physical Chemistry of Surfaces,* $6^{th}$ edition, Wiley-Interscience, New York, ISBN: 0-4711-4873-3, 1997, the disclosure of which is herein incorporated by reference), and is also effective in desensitizing the nitramine particles to unplanned energy stimuli. Second, the binder should fluidize the nitramine particles so that there is a carrier fluid for transport operations. A common misconception is that the binder viscosity must be minimized to perform this role. However, the excessive use of dilution (or plasticization) can increase the negative buoyancy of larger particles in the PSD and contribute to flow problems. An emulsifier is sometimes added to the binder system to help maintain a suspension. Therefore, it becomes obvious that the binder system viscosity should be optimized to be sufficiently low to promote flow, but also sufficiently high to prevent particle settling.

The minimum acceptable viscosity of a PBX formulation ($\eta_{min}$) can be conceptualized by the term relative viscosity ($\eta_r$). This is an empirical quantity that sums the unreacted and unfilled binder system viscosity ($\eta_o$) with the contribution from the optimized PSD and solids fraction used in the PBX formulation ($\phi$) as a function of maximum packing fraction ($\phi_{max}$). There are many expressions for the relative viscosity of a suspension, such as that disclosed in Krieger, I. M. and Dougherty, T. J., "A Mechanism for Non-Newtonian Flow in Suspensions of Rigid Spheres", *Trans. Soc. Rheol.,* 3 (1959), 137; Farris, R. J., "Prediction of the Viscosity of the Multimodal Suspensions from Unimodal Viscosity Data", *Trans. Soc. Rheol.,* 2 (1968), 281; Kitano, T., Karaoka, T., and Shirota, T., "An Empirical Equation of the Relative Viscosity of Polymer Melts Filled with Various Inorganic Fillers", *Rheol. Acta,* 20 (1981), 207; Sadler, L. Y. and Sim, K. G., "Minimize Solid-Liquid Mixture Viscosity by Optimizing Particle Size Distribution", *Chem. Eng. Prog.,* 87 (1991), 68; Ferraris, C. F., "Measurement of the Rheological Properties of High Performance Concrete: State of the Art Report", *J. Res. Natl. Inst. Stand. Technol.,* 104 (1999), 461; Lee, J.-D., So, J.-H., and Yang, S.-M., "Rheological Behavior and Stability of Concentrated Silica Suspensions", *J. Rheology,* 45 (1999), 1117; and, Usui, H., Li, L., Kinoshita, S., and Suzuki, H., "Viscosity Prediction of Dense Slurries Prepared by Non-Spherical Solid Particles", *J. Chem. Eng. Japan,* 34 (2001) 360, the disclosures of which are herein incorporated by reference. The Dougherty-Krieger equation is probably the most appropriate expression for large values of $\phi$, where $<\eta>$ is the intrinsic viscosity, or the slope of the curve when $\phi$ goes to zero (see equation 1, below).

$$\eta_r=\eta_{min}/\eta_0=[1-(\phi/\phi_{max})]^{-(<\eta>)(\phi max)} \quad \text{Eq. 1}$$

Figure 2:
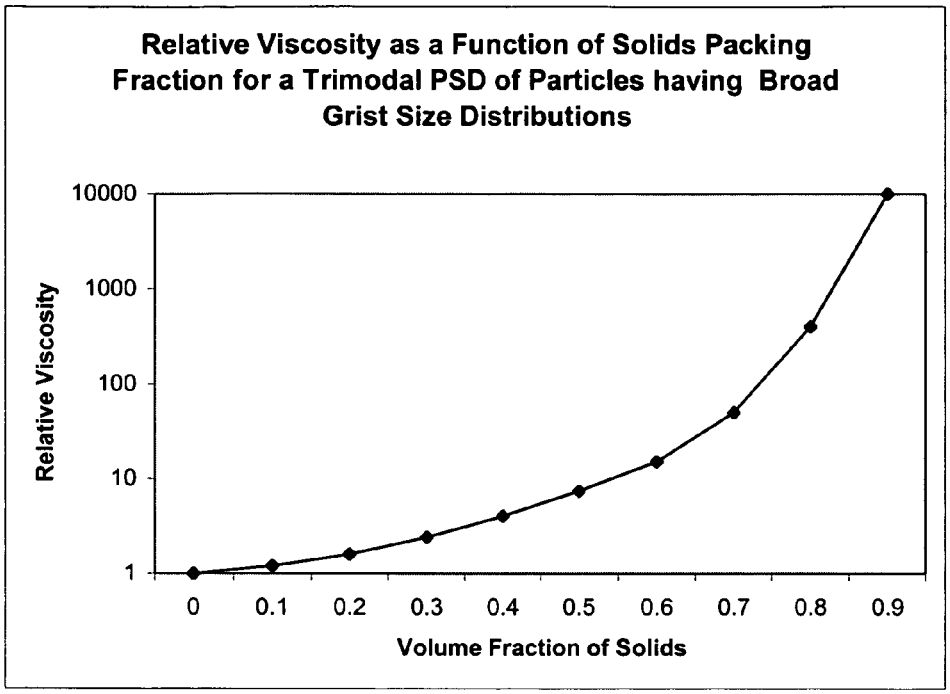
FIG. 2 shows a graph of Relative Viscosity as a function of solids packing fraction for a trimodal particle size distribution (PSD) of Particles having Broad Grist Size Distributions.

As seen in FIG. 2, the effect of solids fractions ($\phi$) upon the calculated relative viscosity ($\eta_r$) is shown. The intrinsic viscosity ($<\eta>$) is the slope of the curve at $\phi=0$. In practice, the maximum packing faction ($\phi_{max}$) for this solids mixture is about 0.83. Accordingly, the minimum acceptable viscosity of this formulation ($\eta_{min}$) is about a factor of 1000 greater than that for the unfilled and unreacted binder ($\eta_0$).

The common way to determine the minimum acceptable viscosity of PBX formulations, and to optimize it, is by experiment over the shear rate range of interest. The experimental methodology needs to have geometric similarity with the processing equipment. In this case, that is the injection loading process. The minimum acceptable viscosity for injection loading PBX formulations is higher than traditional cast PBX formulations because the solids fraction ($\phi$) is higher.

The maximum acceptable viscosity of a PBX formulation ($\eta_{max}$) can be conceptualized by the chemical reaction kinetics of the binder. If the thermosetting polymer is a step type polymerization producing polyurethane, then the rate of reaction is first order and controlled by catalyst concentration. If the thermosetting polymer is a free radical polymerization producing polyacrylate, then the rate of reaction is controlled stoichiometrically by the rate limiting step (see e.g., Allcock, H. and Lampe, F., *Contemporary Polymer Chemistry,* $2^{nd}$ edition, Prentice Hall, Englewood Cliffs, N.J., ISBN: 0-1317-0549-0, 1990). Initiation of the polyacrylate reaction is usually the rate limiting step, and once initiated, the polymerization is sometimes difficult to control. Since the polyurethane reaction produces a binder of threshold molecular weight more quickly and in a more predictable fashion, polyurethane binders are preferred for injection loading. While the maximum acceptable viscosity of a PBX formulation is conceptualized by the reaction rate of the binder, in practice, it is limited by the driving force provided by the processing equipment. The maximum acceptable viscosity for injection loading PBX formulations is higher than traditional cast PBX formulations because the processing equipment can apply a greater driving force.

The PBX formulation is mixed in a unit operation that immediately precedes the injection loading unit operation. The mixing operation can be performed using high shear equipment having clearances of at least twice the mean particle size of the largest grist mode in the PSD. This unit operation can be accomplished as a batch process or a continuous process, both are compatible with the injection loader design.

Figure 3:
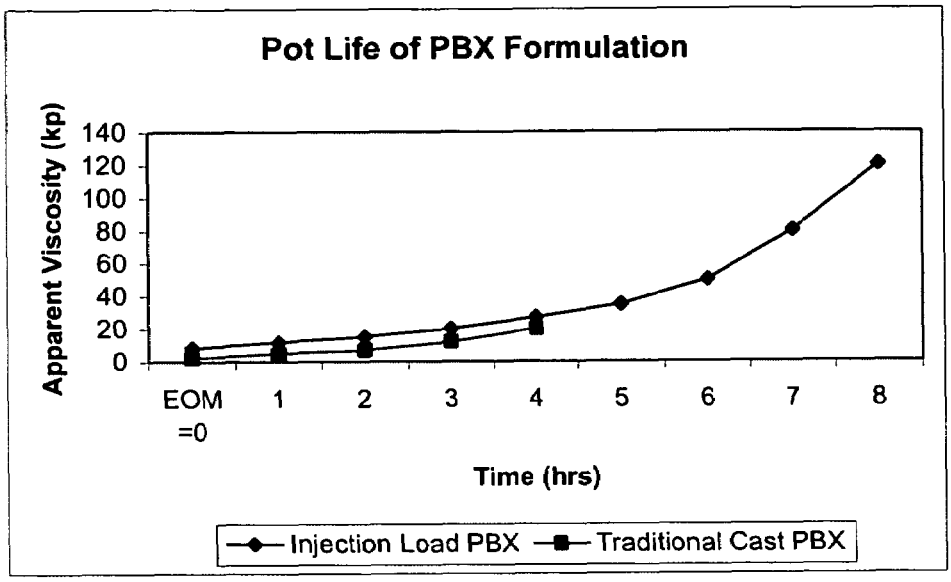
FIG. 3 shows a graph of the Pot Life of PBX Formulation for both injection load PBX and cast PBX.

The timeframe for mixing varies depending upon the specific PBX formulation being processed. However, at the end-of-mix (EOM), the apparent viscosity of the PBX formulation is often very close to the minimum acceptable viscosity ($\eta_{min}$). The timeframe represented by the binder polymerization, occurring from the EOM to the maximum acceptable viscosity ($\eta_{max}$), is referred to as the Pot Life. As shown in FIG. 3, the Pot Life of PBX is illustrated. At a time of zero, the EOM viscosity corresponds to a typical minimum acceptable viscosity ($\downarrow_{min}$). The injection load PBX formulation has a higher $\eta_{min}$ than the traditional cast PBX formulation because of a higher solids content. The injection load PBX formulation also has a higher maximum acceptable viscosity ($\eta_{max}$) because the process equipment offers greater driving force than the traditional cast approach. These advantages enable the Pot Life to approximately double for the injection loading PBX formulation. The timeframe from the EOM to $\eta_{max}$ is also the practical timeframe during which injection loading of containers must be done. The Pot Life for injection loading of PBX formulations is about twice that for traditional cast loading of PBX formulations because the driving force is an order of magnitude greater. In any case, the process engineer needs to have a predictable and consistent Pot Life to ensure that processing parameters can be properly managed during the injection loading operation.

Figure 4:
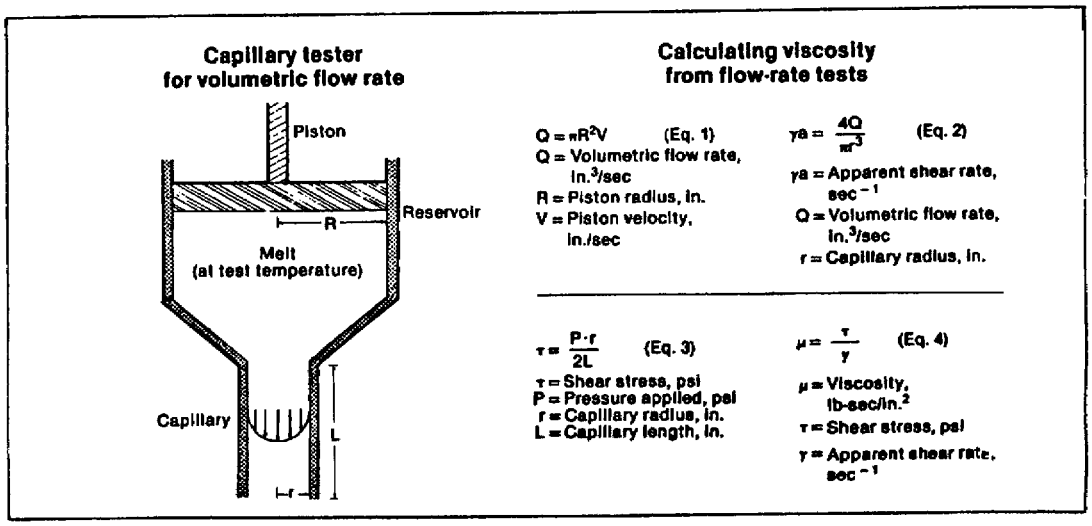
FIG. 4 illustrates various quantities included in algebraic subroutines for monitoring particle migration of highly filled explosive suspensions.

The present invention provides a monitoring function of the fill process to minimize separation within the suspension. As seen in FIG. 4, several algebraic subroutines are illustrated for calculation of the suspension. Rheology is important for any modeling efforts that support process design and process control. Monitoring includes a calculation of volumetric flowrate into the confined container, calculation of apparent shear rate of the explosive composition, calculation of shear stress of the explosive composition, calculation of apparent viscosity of the explosive composition and the like. Shear stress, $\tau(t)$, and shear rate, $\gamma(t)$, are dynamic phenomena that occur during transport operations, such as piston driven dispensing of PBX formulations into containers. Characterization of the shear dependency of these highly filled thermosetting PBX formulations is elusive using commercial techniques. Rotational rheometers such as the Couette (concentric cylinders) device or a mechanical spectrometer that has parallel plates (or cone and plate) usually yield sporadic results because the clearances are too small. Rotating spindle type rheometers can be useful if a helical path is swept through the material. Capillary rheometers can be more successful because they mimic the shear mechanisms of piston driven flow that occur during injection loading. However, the diameter of the capillary should be widened significantly, and appropriate correction procedures should be used. Typically, the Rabinowitsch correction is used to get the shear rate at the wall and the Bagley correction to eliminate the pressure drop due to the entrance region of the capillary (see e.g., Collyer, A. A. and Clegg, D. W., *Rheological Measurement*, Elsevier Applied Science, London, ISBN: 1-8516-6196-4, 1988, the disclosure of which is herein incorporated by reference). When characterized, these PBX formulations exhibit four rheological features important to processing. First, the binders are shear thinning (or have pseudoplastic behavior). The apparent viscosity decreases as a function of increasing shear rate. Second, these viscous suspensions have a yield stress. This is a threshold stress (or driving force) that must to be applied before flow can be observed. A three-parameter model is necessary to describe this rheological behavior (see e.g., Newman, K. E. and Stephens, T. S., Application of Rheology to the Processing and Reprocessing of Plastic Bonded Explosives in Twin Screw Extruders, *IHTR* 1790, NSWC Indian Head, Md., 1 Apr. 1995, the disclosure of which is herein incorporated by reference). The preferred model is the Herschel-Bulkley equation, where $\tau_y$ is the yield stress, m is the experimentally determined apparent viscosity parameter, and n is an experimentally determined pseudoplastic parameter that is specific for different PBXs. When $\phi$ is large, the yield stress, $\tau_y$, can be significant (see equation 2, below).

$$\tau=\tau_y+m|\gamma|^n \quad \text{Eq. 2}$$

During the processing Pot Life the parameter m has a lower limit of $\eta_{min}$ and an upper limit of $\eta_{max}$. Third, these PBX formulations display wall slip (see e.g., Yilmazer, U. and Kalyon, D. M., "Slip Effects in Capillary and Parallel Disk Torsional Flows of Highly Filled Suspensions,"*J. Rheology,* 33 (1989), 1197 and Jana, S. C., Kapoor, B., and Acrivos, A., "Apparent Wall Slip Velocity Coefficients in Concentrated Suspensions of Noncolloidal Particles," *J. Rheology,* 39 (1995), 1123). This phenomenon indicates a boundary layer of plasticizer-rich binder may be at the wall, and transport may occur as a pseudo plug flow. Fourth, at low transport velocity (or low Reynolds number), the bulk PBX flow appears to lose its pseudoplastic behavior and become similar to a Bingham Plastic flow. This infers that the rheological behavior is a function of Reynolds number, and that phenomena observed at low transport velocities (or at low production rates) may intensify or change (from n=1) to become more problematic at higher production rates (where n<1). Therefore, it is important to characterize the rheology of PBX formations over three domains of interest. The first domain is the pot life, and the rheology must be understood with respect to processing time. The second domain is the shear rate range of interest. The third domain is to characterize the transport phenomena over the desired range of Reynolds number.

An expression for volumetric flowrate, Q, through a circular conduit for PBX formulations can be expressed in terms of rheological parameters n and m (equation 3, below).

$$Q=[(\pi n R^3)/(3n+1)][(R\Delta P^{1/n})/(2Lm)] \quad \text{Eq. 3}$$

The driving force applied for momentum transport is the pressure drop, $\Delta P$, and cylindrical plumbing has radius R and length L. The flow of PBX formulations can appear to be predictable, but the rheological features that have been briefly discussed can change m and n values during processing and influence irregular flow with respect to production rate (the amount of applied shear) and PBX pot life. These changes can sometimes contribute to shear induced phenomena that may result in de-mixing during transport through narrow flow channels. Potential problems such as these can be mitigated using smart process design and adaptive process control techniques.

Process Design

There are many variables involved with processing thermosetting PBX formulations. Management of these variables becomes a challenge if the process design is not robust. Since the apparent viscosity is not constant during the Pot Life, and these viscous suspensions (or pastes) have a tendency to change flow behavior, the process geometry design must incorporate features that can prohibit (or minimize) the affects of undesired transport phenomena. If this is accomplished, injection loading has potential to offer pressed quality at a cast price.

The process geometry of manufacturing with highly filled suspension affects induced particle migration. Many commercial filling machines force the fluid (or suspension) through corner turns and abrupt contractions before delivering it to containers. Many injection molding machines force the fluid (or suspension) through a maze of extremely narrow flow channels and corner turns within a mold. However, unlike many commercial fluids (or suspensions), PBX formulations are very highly filled materials that are susceptible to particle jamming, binder filtration, and shear induced demixing if forced through these severe geometries. Therefore, manufacturing science and process engineering experience suggest that a simple geometry is always desired for processing PBX formulations. There are at least three process design criteria that need consideration if the geometry is to be robust. These include elimination of 90-degree corner-turns, elimination of abrupt contractions, and minimizing the length of plumbing.

Figure 5:
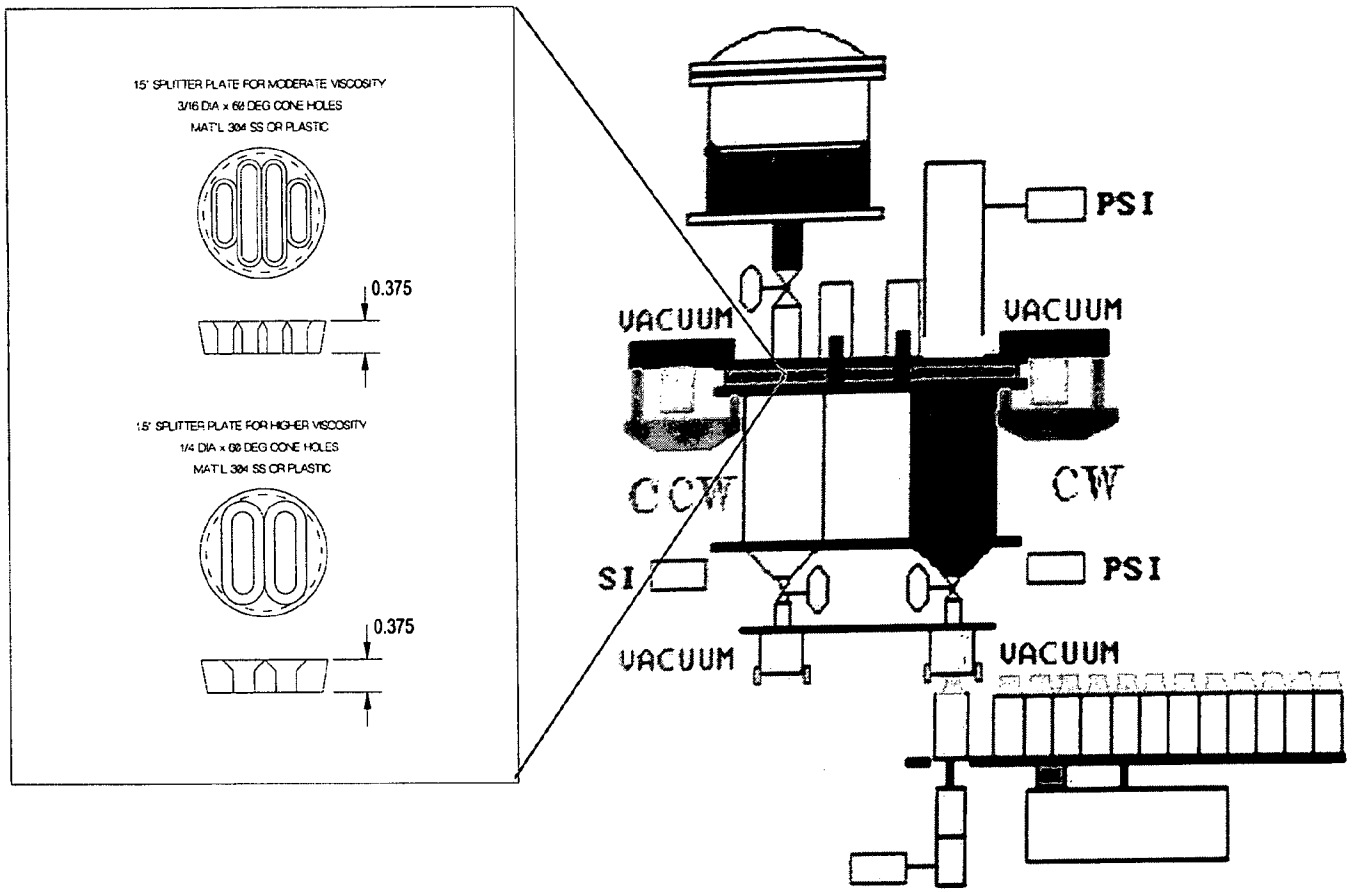
FIG. 5 illustrates an injection loader with a batch mixed PBX reservoir with an exploded view showing representative splitter plate designs for moderate and higher viscosity materials.

The injection loader design of FIG. 1 features two identical chambers on a movable assembly. These right cylinders have a smooth conical contraction into a diaphragm valve (that has no weir). A rotation motor rotates the movable assembly. The method of operation begins with filling one chamber with PBX from the mixing unit operation. As the PBX enters this chamber, vacuum is used to degas the material and remove any entrapped air. When that chamber is full, the movable assembly is rotated 180-degrees to align the degassed aliquot of PBX with the inject piston. Injection loading of the degassed PBX into containers starts under piston driven flow (see FIG. 5). FIG. 5 illustrates an injection loader with a batch mixed PBX reservoir with an exploded view showing representative splitter plate designs for moderate and higher viscosity materials. The two chambers are labeled clockwise (CW) and counter-clockwise (CCW). The injection loader rotates the first chamber filled (and all odd numbered chambers) in the CW direction to position the degassed PBX under the injection piston, as shown. The injection loader rotates the second chamber filled (and all even numbered chambers) in the CCW direction to position the degassed PBX under the injection piston. As seen in FIG. 5, the present invention preferably uses splitter plates having a modified design to separate PBX into strands as it enters the apparatus through a cylinder aligned at the degas position. The strand geometry is variable relative to the percent open area needed for maximum flow and exposing sufficient surface area for vacuum stripping of undesired volatile components from the PBX. Simultaneously, the second chamber has been positioned under the filling station and is ready to accept the next aliquot of PBX. This procedure is repeated until the manufacturing shift is completed. In this manner, the PBX never turns a corner. The straight plumbing design of the twin chambers in the injection loader apparatus eliminates any 90-degree corner turns and prevents processing problems associated with particle jamming and binder filtration.

Figure 6A:
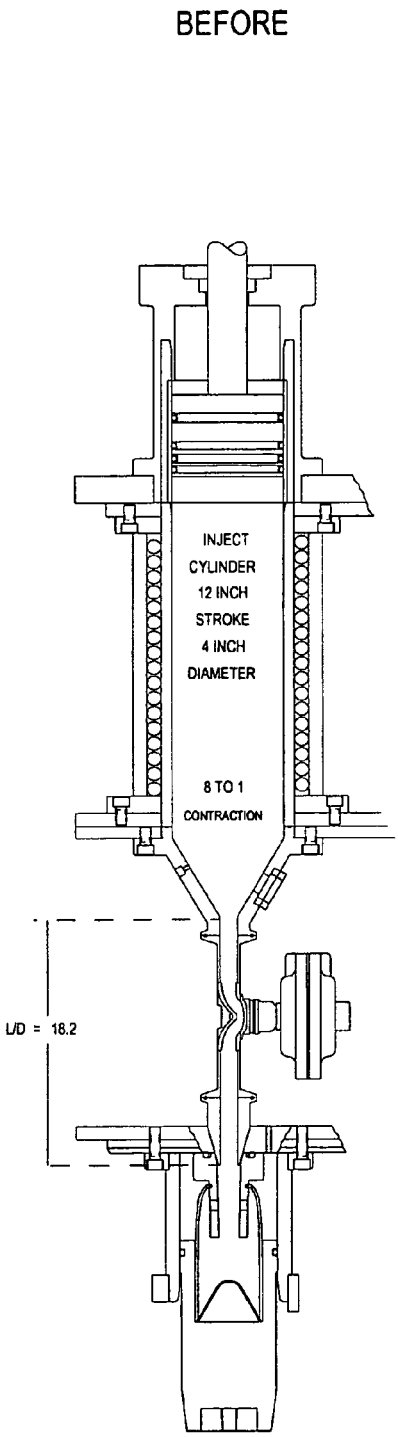
FIGS. 6A, 6B and 6C illustrate injection improvements for factors of less restrictive contraction ratio into the confined container, shorter length to diameter ratio of a feeder mechanism, augmentation of in-line static mixer elements, longer piston stroke of a feeder mechanism, etc., with FIG. 6A representing the inferior injection loading apparatus.
Figure 6B:
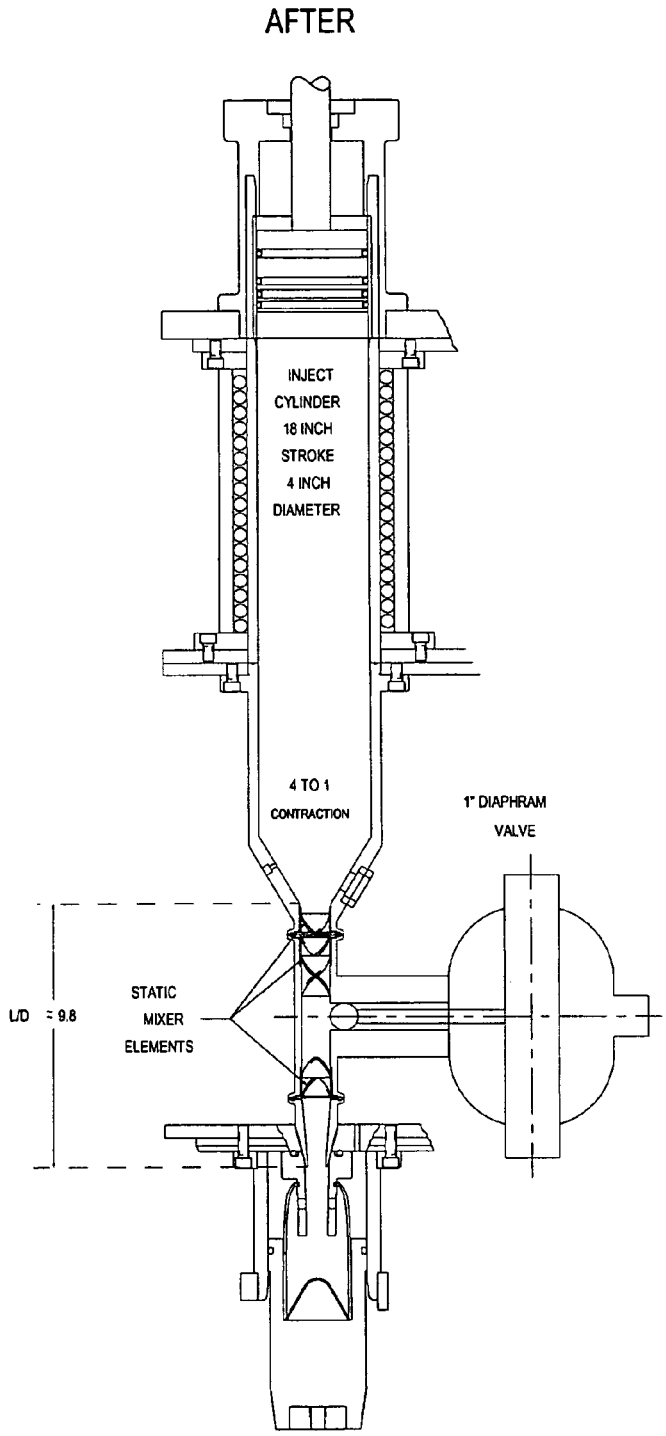
Figure 6C:
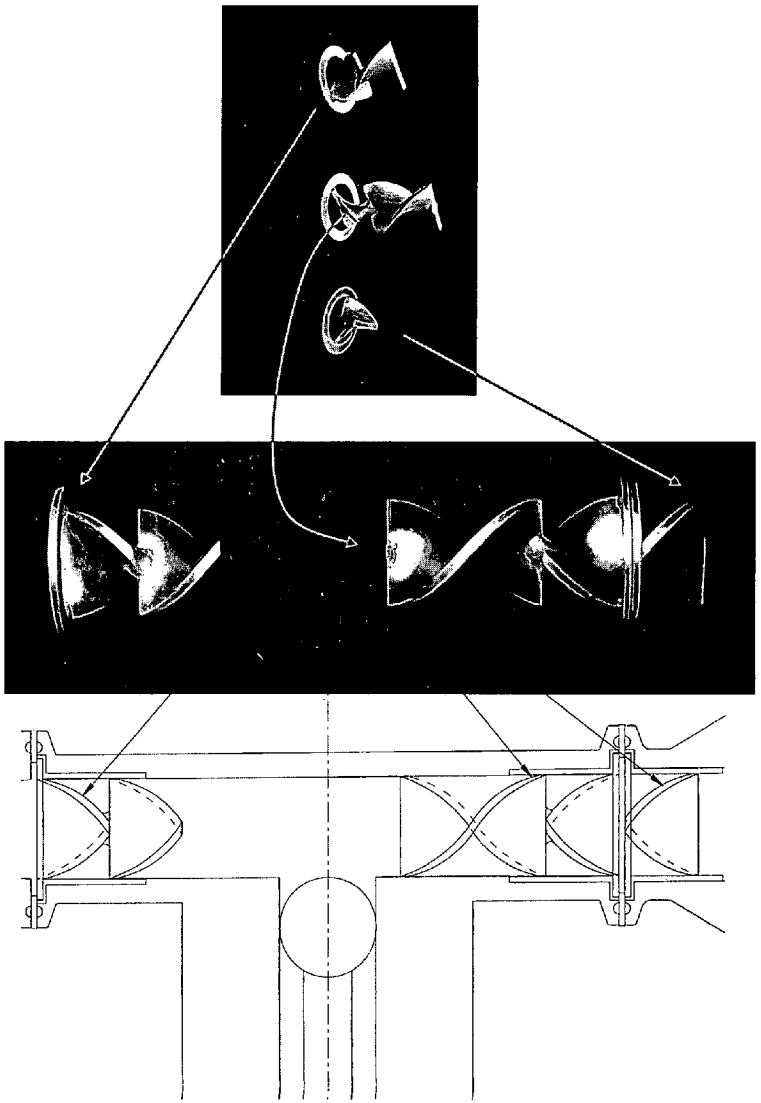
Figure 7:
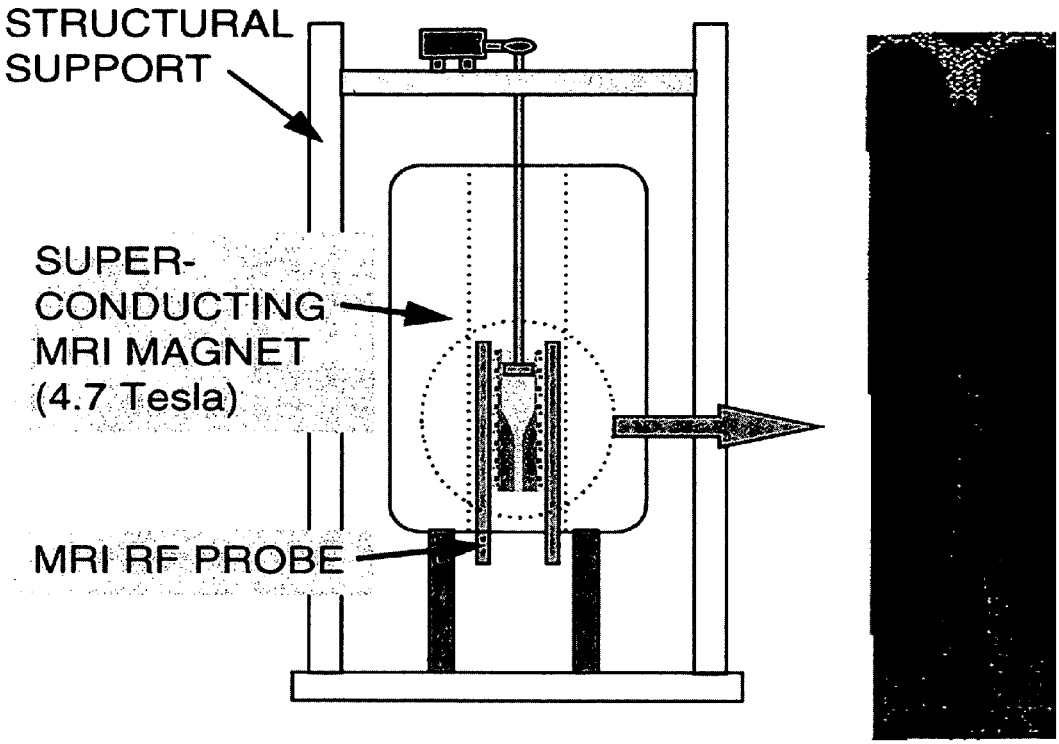
FIG. 7 shows Magnetic Resonance Imaging (MRI) of shear induced particle migration during fill.

Shear induced particle migration of the highly filled suspensions is reduced by modifying or correcting such factors as using less restrictive contraction ratio into the confined container, using a shorter length to diameter ratio of a feeder mechanism, augmenting in-line static mixer elements, using a longer piston stroke of a feeder mechanism, and the like. In FIG. 6, these modifications permit a larger diaphragm valve and a larger PBX flow conduit for injection loading of containers. Abrupt contractions include any reduction that contributes to flow instability. Two generalized examples include a step contraction and a severe taper. Step contraction is the joining of two circular conduits of different diameters. This design has an annular "dead zone" where recirculation occurs. A severe taper is any conical reduction greater than a four-to-one ratio having a prohibitive angle of slide. Apparently well-mixed homogeneous suspensions can de-mix as a function of shear when forced through abrupt contractions. In FIGS. 6A and 6B static mixer elements are added where PBX flow instabilities are most likely to occur. In FIG. 6C, a preferred embodiment includes a series of static mixer elements placed downstream of the contraction that are designed to re-direct and re-mix sheared PBX fluid volumes. The binder-rich boundary layer is re-directed toward the centerline, and the solids-rich centerline is re-directed towards the wall. These in-line static mixers re-distribute sheared PBX and prevent density and concentration gradients in PBX filled munitions. (see Altobelli, et al., "Nuclear Magnetic Resonance Imaging of Particle Migration in Suspensions Undergoing Extrusion," *J. Rheology.,* 41 (1997), 1105) disclosing the use of nuclear magnetic resonance (NMR) imaging techniques (also referred to as MRI techniques) to observe and document de-mixing phenomena of piston driven flow of suspensions through abrupt contractions. As seen in FIG. 7, MRI techniques are useful in determining the extent to shear induced particle migration and/or de-mixing phenomena can be attributed to contraction flow geometry. Contraction ratios of 8:1 may cause de-mixing, especially if the contraction is abrupt. Referring to FIG. 7, the expanded image shows the de-mixing phenomena as an accumulation of binder at the piston head and a simultaneous migration of solids along the centerline of the cylinder that accumulates at the contraction. In a severe case, mass transfer problems can transition into a phenomena known as particle jamming and eventually matting and binder filtration at the contraction entrance. As the piston approaches the contraction, particles migrate toward the plumbing axis (or centerline) where the shear is minimal. The companion phenomenon is that binder can re-circulate along the boundary layer and slowly accumulate at the piston head. This behavior can eventually produce a particle-rich volume element early in a piston stroke followed by a binder-rich volume element late in the same piston stroke. As a result, poor process designs that include abrupt contractions can produce injection loaded containers having density gradients. Modification of the contraction ratios preferably include contraction ratios of less than from about 5:1 (feeder:container inlet) for the feeder, such as from about 4:1 to about 1:1, including such ratios as from about 2:1 to about 4:1, with a more preferred contraction ratio of about 4:1 (feeder:container inlet).

Experiments indicate that it is important to minimize the length of plumbing used for transport of PBX. NMR imaging techniques and computational modeling have been used to examine phenomena in pressure driven flow of suspensions through circular conduits (see e.g., Hampton, R. E., Mammoli, A. A., Graham, A. L., and Altobelli, S. A., "Migration of Particles Undergoing Pressure-Driven Flow in A Circular Conduit," *J. Rheology,* 41 (1997), 621). Initially well-mixed suspensions can start to de-mix and develop microstructures relatively early after shear has been applied. First, a suspension velocity distribution starts to emerge. Then, a different solids fraction distribution begins to take shape. Beyond a threshold entrance length, the solids concentration profile can build to a sharp maximum at the plumbing axis (or centerline). Meanwhile, the suspension velocity profile becomes blunted, similar to Bingham Plastic flow. One of the variables that contributes to the extent of this observed and undesired behavior is the ratio of particle radius (a) to circular conduit radius (R). If the suspension contains large particles (or the a/R ratio is large), especially at high solids concentration ($\phi$), the threshold entrance length of plumbing is short. As a result, poor process designs that include long lengths of plumbing can produce injection loaded containers having density gradients. Preferred feeder length to diameter ratios include less than from about 12:1, with less than from about 10:1 more preferred, and a most preferred feeder length to diameter ratio of about 9:1.

Numerical simulation of concentrated suspension flows has proven to be difficult. However, existing models can be useful in understanding observations and mitigating potential problems in transient flows at low Reynolds number. Particles tend to migrate from regions of high shear to regions of low shear due to irreversible interactions. Also initially well-mixed concentrated suspensions can separate to develop non-uniform microstructures when subjected to inhomogeneous shearing motion. With these phenomena, there are normal stress differences associated with these phenomena. The evolution of solids concentration profiles and suspension velocity profiles has been simulated with reasonable agreement between theory and experiment for some slow flow scenarios applicable to injection loading of PBX. The two approaches used to successfully model observed shear induced particle migration in carefully controlled experiments are complicated and time consuming. The first approach is known as the diffusive flux model (see e.g., Leighton, D. and Acrivos, A., "The Shear-Induced Migration of Particles in Concentrated Suspensions," *J. Fluid Mech.,* 181 (1987), 415; Phillips, R. J., Armstrong, R. C., Brown, R. A., Graham, A. L., and Abbott, J. R., "A Constitutive Equation for Concentrated Suspensions that Accounts for Shear-Induced Particle Migration," *Phys. Fluids A,* 4 (1992), 30; Krishnan, G. P., Beimfohr, S., and Leighton, D. T., "Shear-Induced Radial Segregation in Bidisperse Suspensions," *J. Fluid Mech.,* 321 (1996), 371 and Subia, S. R., Ingber, M. S., Mondy, L. A., Altobelli, S. A., and Graham, A. L., "Modelling of Concentrated Suspensions using a Continuum Constitutive Equation," *J. Fluid Mech.,* 373 (1998), 193. This model is a diffusive equation for the net particle flux derived through scaling arguments based on the consideration of a spatially varying particle interaction frequency and a concentration dependent effective viscosity. The second approach is known as the suspension balance model (see e.g., Nott, P. R., and Brady, J. F., "Pressure-Driven Flow of Suspensions: Simulation and Theory," *J. Fluid Mech.,* 275 (1994), 157; Morris, J. F., and Brady, J. F., "Pressure-Driven Flow of a Suspension: Buoyancy Effects," *Int. J. Multiphase Flow,* 24 (1998), 105 and Morris, J. F., and Boulay, F., "Curvilinear Flows of Noncolloidal Suspensions: The Role of Normal Stresses, *J. Rheology,* 43 (1999), 1213) This model is based on the conservation of mass and momentum for both the particle phase and the suspension phase. Both of these approaches involve challenging computations and require finite element Navier-Stokes solvers.

An over-simplified form of the diffusive flux model reveals fundamental relationships important to injection loading concentrated suspensions, such as PBX, into containers. The evolution of solids concentration profiles ($d\phi/dt$) is probably the most important concern, and it can be generalized as a function of particle radius (a), shear rate ($\gamma$), and apparent viscosity ($\eta$), see equation 4 below.

$$d\phi/dt=f(a^2,\gamma,\eta^{-1}) \quad \text{Eq. 4}$$

This means that there are some practical things to be considered that can minimize the transport phenomenon of shear induced particle migration. First, small particles should be preferred to large particles in the PSD. Second, the viscosity of the binder should be maximized to maintain the suspension. Finally, the applied shear rate during transport should be minimized. Process design features can be employed to minimize and redistribute shear. In addition to the previous discussion, installing short lengths of in-line static mixers immediately downstream of a contraction can re-mix (or redirect) previously sheared material that may have become de-mixed. Process control techniques can also be used to limit the applied shear rate and eliminate the potential density gradient concern in the final product.

Process Control

The present invention includes a process control for mitigating shear induced particle migration of highly filled explosive suspension during injection loading of the explosive suspension into a confined container. As seen in FIGS. 8A and 8B, the present invention preferably includes a densitometer. A preferred embodiment of the densitometer includes a RONAN gamma-ray densitometer, such as one having adjustable positions to accommodate processing diagnostics and process control requirement for filling different munitions with the explosive suspension, such as PBX. FIG. 8A illustrates a side view of the cylinder in the injection position showing RONAN densitometer detector (sensor) and source with respect to the heat transfer jacket and the injection cylinder contraction. FIG. 8B illustrates both cylinders showing the location of the RONAN densitometer detector (sensor) and source with respect to valves, rotation, and posts.

There are two fundamental approaches to process control architecture. First, the traditional Ziegler-Nichols control theory provides for proportional, integral, and derivative (PID) parameters that can be used to manipulate variables and correct predictable disturbances. The availability of inexpensive microprocessors and the familiarity of simple relationships make the PID approach attractive for processes at steady state. However, injection loading of PBX into containers never achieves steady state. Additionally, the shear induced disturbances can be irregular. As seen in FIGS. 9A and 9B, showing ram displacement and velocity versus time in 9A and shear rate and shear stress versus time in 9B, injection loading relatively low viscosity PBX presents process control difficulties. As evident in FIG. 9A, monitoring ram displacement and velocity did not provide sufficiently predictable or reproducible results for a traditional control strategy. As evident in FIG. 9B, monitoring shear properties was more reliable, but not fully reliable. Therefore, the second approach of using adaptive process control techniques is more appropriate for injection loading of PBX. Adaptive techniques can include either Fuzzy Logic or Neural Networks. These are model-based and expert-based control strategies that use an integrated control scheme of multiple inputs and multiple outputs (MIMO). A design of experiments is typically used to determine the matrix of transfer functions that relate manipulated variables (or input variables) to the controlled variables (or output variables). The method includes a series of time steps in which one manipulated variable is altered at a time and the response of controlled variables is measured as a function of time. Selection of the appropriate adaptive control strategy usually follows an assessment of feasibility that considers stability and ease of implementation. It is not uncommon that different types of PBX can exhibit unique relationships, or transfer functions, between manipulated and controlled variables.

The injection loading process for PBX uses a supervisory process control software that is run on a personal computer (PC), and monitors processing parameters necessary to track mass transfer and momentum transport phenomena. Some of these parameters are the vacuum level in the degassing chamber, vacuum level in the shroud where the container is evacuated, temperature of the PBX in the injection chamber, piston displacement, hydraulic pressure driving the piston, cavity pressure of the PBX entering the container, and time. In addition, real-time calculations are performed to determine piston velocity, shear rate (as a function of Q), shear stress (as a function of $\Delta P$), and apparent PBX viscosity (as a ratio of shear stress and shear rate). These parameters become a menu of inputs that can be used in the adaptive control strategy.

Figure 10:
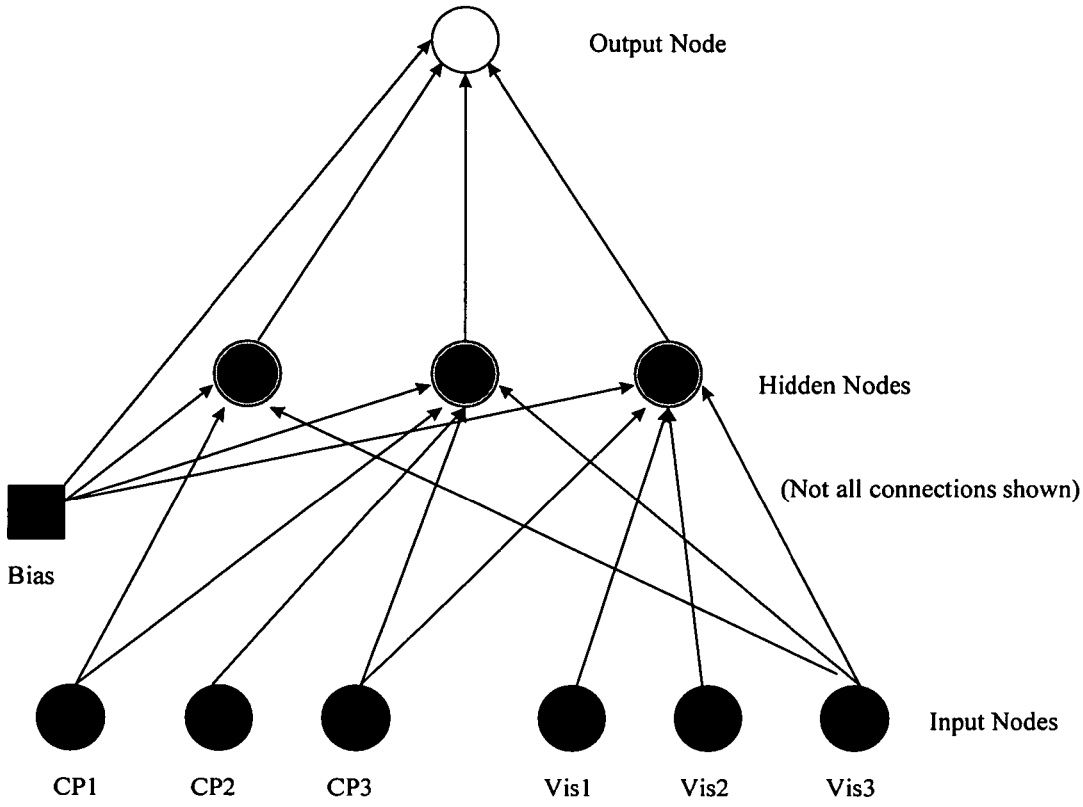
FIG. 10 shows an example neural network framework of the present invention; and, FIG. 11 shows various specialized submunition configurations filled using the process design and control of the present invention.

Standard back-propagation neural networks have been used to successfully to recognize disturbances early in the injection loading cycle (see e.g., Smith, R. E., Parkinson, W. J., Hinde, R. F., Newman, K. E., and Wantuck, P. J., "Neural Network for Quality Control of Submunitions Produced by Injection Loading," 2$^{nd}$ *International Conference on Engineering Design and Automation, Maui, Hi.,* 9-12 Aug. 1998). FIG. 10 shows an example neural network framework that has been used to recognize the onset of undesirable phenomena and invoke corrective action in time to avoid the manufacture of reject product. The input variables were cavity pressure (CP) of the PBX entering the container and the calculated apparent PBX viscosity (VIS). Using cavity pressure (CP) and viscosity (Vis) input nodes, and three hidden nodes, the network was able to recognize patterns of difference between acceptable and unacceptable phenomena sufficiently early in the processing cycle to invoke corrective action. In limited testing and demonstration of an injection loading cycle having ten time steps, this neural network output correctly predicted the result of either good or reject product after only four time steps when compared to traditional post-mortem radiography. This means that a neural network framework provides sufficient time to take corrective action during processing. Once identified, the corrective action can be invoked within one time step to resolve the influence of the disturbance well before the injection loading cycle is complete. Early detection of CP and VIS disturbances allows recognition of shear-induced problems. Correction of these problems and avoidance of reject product is achieved by controlling the applied shear rate within acceptable limits. Therefore, this adaptive process control strategy has been useful for injection loading PBX into containers.

Injection loading technology for PBX materials is dependent upon the proper characterization of particles and understanding their behavior during processing. The PSD in PBX formulations is important for final product performance. Injection loading can be an efficient automated unit operation for many PBX applications if the PSD is maintained throughout the manufacturing process at the production rate desired. This can be achieved when the PBX formulation is appropriate, the process design is simple and robust, and the applied shear can be controlled within acceptable limits. Additionally, real time diagnostic explosive quality evaluation may occur to effectively permit ejection of particular loads and to track the rejected loads.

Example 1

Highly filled explosive PBX suspensions were used to fill munitions. The process included monitoring and controlling the shear rate and shear stress using critical I/O of ram displacement (y) and cavity pressure (P). Ram velocity (or piston velocity, V) from ram displacement was calculated to get the volumetric flowrate (Q) to determine the shear rate. With P quantified, the shear stress was determined. By monitoring either the shear rate and shear stress, or apparent viscosity (C), the value or these shear properties every scan rate are compared against a set-point, that is specific for different PBX formulations. The primary corrective action to resolve process disturbances, is to control the ram displacement in real time. However, since injection loading of high filled suspensions such as PBX is complicated, there are several other process parameters that warrant monitoring. These I/O include, PBX density, PBX temperature, vacuum levels. There are also complicated inter-relationships between process variables that warrant monitoring that may also trigger the need for corrective action. These include the relationship between density and vacuum levels, density and volumetric flowrate, and the relationship between cavity pressure and viscosity. This latter inter-relationship is utilized in a neural network for early detection of process disturbances. The neural network output was either a pass (1) or a fail (0). With a failure (0), corrective action is taken to change the ram displacement and resolve the disturbance.

Example 1A

Using the process of Example 1, manufacturing of PBX munitions provided a rejection rate of less than 2%.

Example 1B

Figure 11:
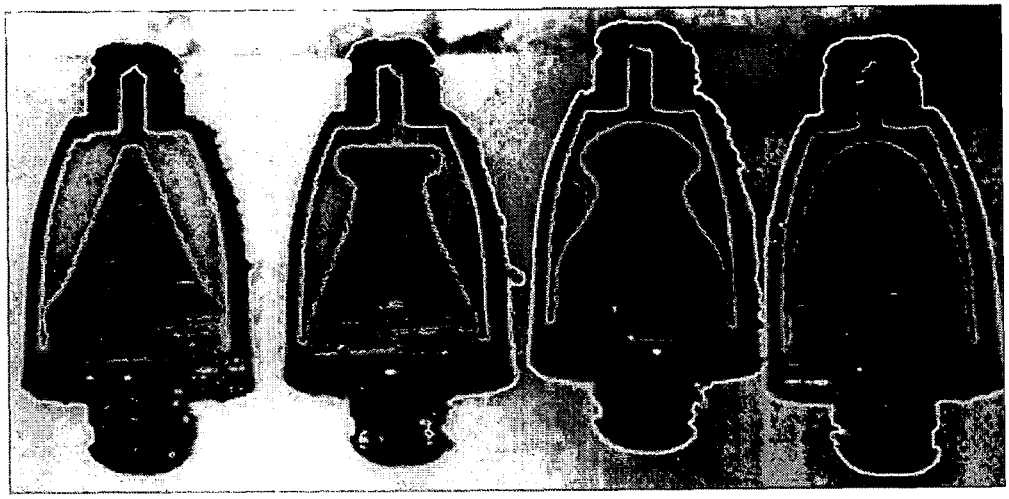

Manufacturing of PBX munitions using injection load PBX into specialized shaped sub-munitions was accomplished (see FIG. 11).

The foregoing summary, description, and examples of the present invention are not intended to be limiting, but are only exemplary of the inventive features which are defined in the claims.

What is claimed is:

1. A process for mitigating shear induced particle migration of explosive suspensions during injection loading of the explosive suspension into a container, comprising:

monitoring said process for initiating performance of a corrective process control for minimizing particle migration within the explosive suspension; and, correcting flow parameters effective for reducing the particle migration, wherein said monitoring comprises using a neural network framework, which includes a plurality of input nodes and a plurality of hidden nodes, for real-time monitoring of process parameters to initiate said corrective process control, wherein said corrective process control comprises process diagnostics and process control requirements are accommodated to fill different munitions with said explosive suspension through use of a densitometer, wherein said correcting flow parameters is a corrective action for a non-steady state process invoked within one time step to resolve an influence of a disturbance before an injection loading cycle is complete, and wherein said correcting flow comprises shear is re-distributed in said explosive suspension, and density and concentration gradients are prevented in said different munitions when filled through use of in-line static mixers.

2. The process of claim 1, wherein said correcting comprises modification of a splitter plate design and varying a process strand geometry.

3. The process according to claim 1, wherein the explosive suspension is a highly filled explosive suspension.

4. The process according to claim 1, wherein the container is a confined container.

5. The process according to claim 1, wherein said monitoring comprises evaluating at least one parameter of said process.

6. The process according to claim 1, wherein said monitoring comprises evaluating at least one property of said explosive suspension.

7. The process according to claim 1, wherein said corrective process control is an in-situ corrective process control.

8. The process according to claim 1, wherein said corrective process control is an adaptive process control to predict disturbances, preemptively, in order to invoke said correcting for preventing manufacture of a defective ordnance.

9. The process according to claim 1, wherein said particle migration is shear induced particle migration.

10. The process according to claim 1, wherein said correcting comprises optimization of particle size distribution.

11. The process according to claim 1, wherein said correcting comprises controlling applied shear-rate within acceptable limits to minimize separation within said explosive suspension.

12. The process according to claim 1, wherein said neural network framework comprises said plurality of input nodes and an output node.

* * * * *